US008986534B2

(12) United States Patent
Yusuf et al.

(10) Patent No.: US 8,986,534 B2
(45) Date of Patent: Mar. 24, 2015

(54) METHOD FOR REMOVING OXYGEN FROM A REACTION MEDIUM

(75) Inventors: Zaki Yusuf, Dhahran (SA); Ahmad D. Hammad, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 132 days.

(21) Appl. No.: 13/540,964

(22) Filed: Jul. 3, 2012

(65) Prior Publication Data

US 2013/0118914 A1 May 16, 2013

Related U.S. Application Data

(60) Provisional application No. 61/559,186, filed on Nov. 14, 2011.

(51) Int. Cl.

| | |
|---|---|
| ***C25B 1/30*** | (2006.01) |
| ***C25B 3/04*** | (2006.01) |
| ***C10G 32/02*** | (2006.01) |

(52) U.S. Cl.

CPC . *C25B 3/04* (2013.01); *C10G 32/02* (2013.01); *C25B 1/30* (2013.01); *C10G 2300/1037* (2013.01)

USPC ..... 205/466

(58) Field of Classification Search

CPC ..... C25B 1/30

See application file for complete search history.

(56) References Cited

U.S. PATENT DOCUMENTS

| | | | | |
|---|---|---|---|---|
| 2,091,130 | A | 8/1937 | Berl | |
| 3,915,819 | A | 10/1975 | Bell et al. | |
| 3,928,066 | A | 12/1975 | Lewenstein | |
| 4,801,511 | A | 1/1989 | Young | |
| 5,112,702 | A | 5/1992 | Berzins et al. | |
| 5,552,245 | A | 9/1996 | Li et al. | |
| 6,712,949 | B2 | 3/2004 | Gopal | |
| 6,821,681 | B2 | 11/2004 | Fitter | |
| 7,012,059 | B2 * | 3/2006 | Baines et al. | 510/506 |
| 7,060,244 | B2 | 6/2006 | Devic | |
| 7,282,528 | B2 | 10/2007 | Asano et al. | |
| 7,326,329 | B2 | 2/2008 | Gomez | |
| 7,563,373 | B2 * | 7/2009 | Bolduc | 210/619 |
| 7,604,719 | B2 | 10/2009 | Vanden Bussch et al. | |
| 7,754,064 | B2 | 7/2010 | Buschmann et al. | |
| 2003/0019758 | A1 | 1/2003 | Gopal | |
| 2008/0241683 | A1 | 10/2008 | Fensore et al. | |
| 2009/0145806 | A1 | 6/2009 | Hamad | |
| 2010/0126346 | A9 * | 5/2010 | Farha et al. | 95/138 |

FOREIGN PATENT DOCUMENTS

| | | | |
|---|---|---|---|
| CN | 101709481 | A | 5/2010 |
| CN | 101826638 | A | 9/2010 |
| EP | 0351772 | A2 | 1/1990 |
| JP | 2001-236968 | A | 8/2001 |
| JP | 2004-143561 | A | 5/2004 |
| WO | 9325636 | A1 | 12/1993 |
| WO | 2011/015500 | A1 | 2/2011 |

OTHER PUBLICATIONS

Gyenge et al, The Surfactant-Promoted Electroreduction of Oxygen to Hydrogen Peroxide, Journal of the Electrochemical Society, 152(3) (2005), pp. D42-D53.*

Elod Gyenge, et al., "The Surfactant-Promoted Electroreduction of Oxygen to Hydrogen Peroxide," J. Elchem. Soc., D42-53 (Jan. 28, 2005).

Ahmad D. Hammad, et al., "In-Situ ELectrochemical Desulfurization of Crude Oil and Its Fraction," Saudi Aramco Journal of Technology, Sep. 1, 2012.

International Search Report for PCT/US2012/063682 dated Jun. 13, 2013 (5 pages).

* cited by examiner

*Primary Examiner* — Keith Hendricks
*Assistant Examiner* — Salil Jain
(74) *Attorney, Agent, or Firm* — Abelman, Frayne & Schwab

(57) ABSTRACT

The invention relates to a method for removing oxygen from a water containing reaction medium. A pair of electrodes (cathode and anode), are added to the medium, with a surfactant attached to the surface of at least one of the cathode and anode. The medium is kept at an acidic pH, and an electrical current is applied. Oxygen is drawn to the electrodes, displacing surfactant, and reacts with $H^+$ ions and $H_2O$ molecules to form $H_2O_2$, which can then be removed.

8 Claims, No Drawings

METHOD FOR REMOVING OXYGEN FROM A REACTION MEDIUM

RELATED APPLICATION

This application claims priority from provisional application No. 61/559,186 filed Nov. 14, 2011, incorporated by reference in its entirety.

FIELD OF THE INVENTION

This invention relates to methods for removing or scavenging oxygen molecules in situ, during electrochemical processes.

BACKGROUND AND PRIOR ART

Many chemical reactions involve the production of oxygen or infiltration of the reaction system by oxygen molecules. The reactions and manner in which this happens are well known to the skilled artisan as are the ramifications which include, e.g., undesired chemical and/or electrochemical reactions leading to undesirable, potentially reactive byproducts, oxidation of reactants which are necessary for the desired reaction, and corrosion of the materials used to produce reaction vessels. In certain situations, such as hydrocarbon processing, the build up of excess oxygen is not only a safety risk, but also a cause of revenue loss due to the undesirable depletion of hydrocarbon feedstock as a result of the oxidation of the feedstock, whether the reaction is carried out at ambient or elevated temperatures. The adverse effects can and do occur even when trace amounts of oxygen are present.

Desulfurization of crude oil is an important industrial process, commonly carried out via "hydrotreatment." Conventional hydrotreatment requires relatively high temperature and pressure parameters, as well as high hydrogen partial pressures to remove organic sulfur. During nonconventional in situ desulfurization processes, organic sulfur compounds are electrocatalytically converted to easily removable sulfur compounds through hydrogenation reactions, while hydrogen is replenished via water molecules, when these are split into hydrogen ions (H+) and oxygen at the anode. The resulting oxygen and its buildup is problematic and of concern, as it is an oxidizer of sulfur and as well as of hydrocarbon feedstock, and a possible cause of combustion of the hydrocarbons.

Further, when oxygen (along with moisture) is present in these systems, it is well known that it may corrode the reactor vessels and associated equipment. Other materials, such as trace metals, acids, salts, bases, charged electrodes and high concentration of $H_2$ under high pressure, can aggravate these problems, especially when moisture is present. When moisture is present, an electrical circuit can be created, resulting in the depletion or degradation of the materials of the reactive vessel and materials which make up the processing equipment.

All of these, as well as other reasons known to the skilled artisan, point to a need to remove the dissolved oxygen from systems, be they aqueous or non-aqueous. Further, if the oxygen could be scavenged and converted into one or more useful materials, this would add value to any of these reaction systems.

Methods for removing oxygen and moisture from reaction systems are known; however, it is also known that these conventional methods frequently become impediments to the processes of interest. Many of these removal methodologies are difficult to implement, and/or are not economically viable.

Hence, a methodology to remove oxygen from reaction systems which is non-invasive, simple to implement, and produces a useful product, would be a great advancement in the art.

It is a feature of the invention to provide a method for removing excess oxygen from a reaction system by converting it to a useful product, i.e., hydrogen peroxide ($H_2O_2$), and thus avoid or alleviate the problems discussed supra. How this is accomplished will be seen in the disclosure which follows.

SUMMARY OF THE INVENTION

The invention relates to removal of oxygen from a reaction medium when it is being produced during electrochemical, in situ production of hydrogen, which is used for electrocatalytic desulfurization of organic sulfur compounds, in the presence of two electrodes (cathode and anode) in the reaction system. In this process, the oxygen generated from the water, which may be present as atomic, molecular or ionic oxygen in the medium, is targeted for easy conversion to removable/extractable byproduct(s). This is accomplished in the presence of electrolytes and surfactants that act as both charge carrier and catalyst, in order to scavenge oxygen and to convert it to easily removal products, in a hydrocarbon media, in the presence of water. This scavenging may take place at various conditions, via electrochemical oxidation or conditions that are both below and above, as well as being at, ambient temperature and pressure.

DETAILED DESCRIPTION OF PREFERRED EMBODIMENTS

The invention as described herein is a method for selective, electrochemical conversion of oxygen that is dissolved in a reaction medium into hydrogen peroxide, in the presence of a surfactant. Some of the surfactant molecules facilitate the reaction of in situ hydrogen and oxygen to form $H_2O_2$, at an electrode placed in the reaction medium.

By "oxygen," it is understood that all forms of the element, including atomic, molecular and ionic forms, are encompassed herein. Similarly, the surfactant may be any surfactant, i.e., it may be a cationic, anionic, or zwitterionic surfactant. Further, it is to be understood, that "reaction of hydrogen" refers to molecular or atomic hydrogen, as well as hydrogen in a molecule of $H_2O$.

To elaborate, the invention involves placing an electrochemical cell which contains a cathode and an anode into a hydrocarbon mixture, together with an aqueous solution of acid, such as $H_2SO_4$, and the surfactant.

In practice, the surfactants may, e.g., become dissociated or ionized, and/or weakly adsorbed, on the surface of the electrodes, when an appropriate electrical potential and pH environment are provided and maintained. The strength of binding between the surfactant and the electrode is dependent upon the number of carbon atoms in the surfactant's hydrophobic tail and/or the applied potential. While not being bound to any particular theory, it is believed that when $H^+$ ions (provided by the acid solution), water, and oxygen are in the vicinity of a cathode to which the surfactant is adsorbed, the stronger affinity of the ions for the electrode causes displacement of some of the surfactant molecules, with concomitant reaction of oxygen and hydrogen to form $H_2O_2$. Any counter ions of the surfactants either move as free ions, or migrate to the surface of the anode where they may or may not react to form molecular entities.

Also, at appropriate potentials, a fraction of water molecules in the vicinity of the anode react with atomic oxygen to form $H_2O_2$. When hydrogen peroxide is formed at the anode, the surfactants are weakly attached to the anode with its counter ion attached to the surfactant molecules, thus preventing formation of an increased amount of molecular oxygen. The formation of hydrogen peroxide takes place because surfactant molecules reduce the probability of oxygen atoms assuming positions next to each other, and forming oxygen molecules ($O_2$). Instead, atomic oxygen reacts with water molecules to form hydrogen peroxide. Hence, it will be seen that the method of the invention may be carried out continuously or intermittently, depending upon the potential applied to the poles of the circuit.

It should be noted that the anode provides a source of ions, which are depleted, continuously, as a result of the formation of molecular hydrogen, or hydrogen peroxide at the cathode. As this occurs, $H^+$ formed at the anode surface moves to the cathode and reacts as described supra. At an appropriate potential, water molecules in the vicinity of the anode can react with atomic oxygen, to form $H_2O_2$. These then move to the cation where they react as described supra. Hence, it will be seen that the method of the invention may be carried out continuously or intermittently, depending upon the potential applied to the poles of the circuit.

In operation, e.g., in a system for removing sulfur from hydrocarbon fuel, a batch reactor is equipped with appropriate liners, an external heat source, and an electrochemical cell. The reactor is then filled with water, an acid, preferably $H_2SO_4$, and an amount of a surfactant. These materials are then mixed, after which the hydrocarbon fuel is added thereto. The system is checked for leaks and, if necessary, adjustments are made. An electrochemical circuit is then completed, applying current (or applying potential) via an external means, to the electrochemical cell. The temperature of the reactor is increased to permit the reaction to go forward faster. After a desired, predetermined length of time, the circuit is opened, thus breaking current flow and the reaction. Sampling of gasses produced are taken and analyzed, following art recognized methods, to assess the success of the reaction.

The amount of surfactant added may vary and is not dependent upon the critical micelle concentration, i.e., the concentration of surfactant at which any surfactant added in excess thereof form micelles, rather than dissolving into the system. An amount of surfactant at the critical micelle concentration ("CMC") is preferred, as the conductivity of the sample reaches a plateau at this point. Better charge transfer occurs when the conductivity is higher.

The skilled artisan will recognize that the "CMC" value differs for each surfactant, but generally ranges from 0.01-1.0 wt % of the sample to which it is added.

The acid in the system preferably ranges from 0.01-0.25 M relative to the entire solution, and is added in an amount to keep pH less than 6.0.

The electric potential applied to the system may vary during the course of the reaction, but is preferably between −1 and −4 V.

It is preferred to use, as the surfactant, one which attaches to an electrode surface with some strength and partial coverage, but not to a degree where removal therefrom is difficult and prevents the desired reaction from occurring. The degree to and strength with which the surfactant molecule attaches to the electrode depends upon the length of its hydrophobic, carbon chain. Preferably, the chain contains from between 8 and 20 carbon atoms, more preferably 10 to 18, and most preferably, from 12 to 16 carbon atoms. Especially preferred are "CTAB" or cetyl trimethyl ammonium bromide and "DTAB" or dodecyl trimethyl ammonium bromide. Of these two, DTAB is most especially preferred.

The invention will be elaborated upon in the examples which follows.

EXAMPLE

A mid-pressure batch reactor was equipped with Au and Pt electrodes, as the working and counter electrodes, respectively. These electrodes were used to generate hydrogen in situ, which in turn was used for desulfurization of hydrocarbons. A constant current (0.03 amps) was applied to the working electrode, which resulted in the generation of hydrogen, as well as oxygen, via electrochemical splitting of water.

Water (25 ml), hydrocarbons (diesel fuel), $H_2SO_4$, and various charge carriers (1-ethyl-3-methylimidazolium bistrifluoromethyl sulfonate; 1-ethyl-3-methylimidazolium trifluoromethyl sulfonate (25 ml)) or surfactants (CTAB, DTAB (0.26 g)) were used.

$H_2O_2$ was measured in both the aqueous and hydrocarbon phases of the reaction mixture, using a commercially available product permitting visual detection thereof.

The temperatures at which the reactions took place ranged from 200-240° C., while pressures varied between 450-600 psia.

Vapor phase reaction products were removed via a sampling port in the reaction vessel, and analyzed via standard methodologies. These gas analyses revealed that at least a portion of the hydrogen being produced in situ was taking part in the electro catalytic process, and part of the generated oxygen contributed to partial oxidation of $CO_2$. After several hours, the reaction mixture was allowed to cool to room temperature, and the liquid sample was analyzed for sulfur content.

The analysis of the gases removed from the reaction mixture showed that, when an ionic liquid was used, 23% (by volume) of hydrogen, and 10% (by volume) of oxygen were observed in the vapor phase; however, when the ionic liquid was replaced by a surfactant, the amount of hydrogen increased to 60%, while oxygen dropped to less than 1%.

A current of 0.03 amps was applied constantly, resulting in the production of hydrogen at the working electrode, and oxygen at the anode, as a result of the electrochemical splitting of water molecules.

Vapor phase reaction products were then analyzed, and it was observed that a portion of the hydrogen produced in situ was employed in the electro-catalytic hydro treatment process, while a portion of the oxygen were consumed during the oxidation of hydrocarbon to $CO_2$, which is an undesirable byproduct, and a portion remained unreacted.

After permitting the reaction to proceed for several hours, the temperature was reduced to room temperature, and liquids were removed for analysis of sulfur content.

The foregoing disclosure sets forth various embodiments of the invention, which is a method for removing oxygen from a reaction medium containing it. The method involves placing an anode and a cathode into the reaction system, where the electrode or electrodes have at least one surfactant attached to its or their surface. If the reaction system is not already acidified, acid is added, and an electrical current is applied. Upon application of the current, the surfactant molecules ionize, and oxygen molecules move to the cathode, displacing surfactant molecules, and reacting with $H^+$ ions and $H_2O$ molecules in the reaction system, to produce $H_2O_2$. In parallel, at the anode, a portion of the reactive atomic oxygen formed at or near that surface, is unable to "find" additional atomic oxygen to react with, and instead reacts with $H_2O$ to form $H_2O_2$, with a commitant drop in the concentration of molecular oxygen. The $H_2O_2$ can be removed and used in any process known to utilize $H_2O_2$.

The $H^+$ in the reaction system can be provided by the acid, or can be generated by the anode, in the course of the generation of the electrical current.

The preferred acid is $H_2SO_4$, but any acid, especially mineral acids, such as $HNO_3$ or HCl may be used as well. The amount of acid added to the reaction medium will vary, depending on the acid itself, as well as its concentration (preferably from about 0.01-0.25 M), so as to keep the pH of the reaction system less than about 6.0.

The surfactant, as noted supra, may be anionic, cationic, or zwitterionic, at the critical micelle concentration for the particular surfactant. Preferably, the surfactant contains a chain of from 8 to 20, more preferably 10 to 18, and most preferably, 12 to 16 carbon items, as do especially preferred surfactants "CTAB" or "DTAB."

During the operation of the reaction, the electrochemical circuit created will range from −1 to −4 V, and may be kept constant, or vary.

The invention is especially useful in removing oxygen from hydrocarbon fuels, such as crude oils, or other hydrocarbon fuels known to the skilled artisan.

Other aspects of the invention will be clear to the skilled artisan and need not be elaborated upon herein.

The terms and expression which have been employed are used as terms of description and not of limitation, and there is no intention in the use of such terms and expression of excluding any equivalents of the features shown and described or portions thereof, it being recognized that various modifications are possible within the scope of the invention.

The invention claimed is:

1. A method for removing oxygen from a water and crude oil containing reaction medium comprising placing a cathode and an anode into said reaction medium together with a surfactant, wherein said surfactant is adsorbed to at least one of said cathode and said anode, and applying an electrical potential created by said cathode and anode to said reaction medium, to attract molecular oxygen in said reaction medium to said cathode and atomic oxygen in said reaction medium to said anode with displacement of molecules of said surfactant into said reaction medium, and reacting said atomic oxygen with $H^+$ ions and $H_2O$ to produce $H_2O_2$, at a temperature of from 200° C. to 240° C.

2. The method of claim 1, further comprising adding an acid to said reaction medium to lower pH of said reaction medium to below 6.0.

3. The method of claim 1, wherein said surfactant comprises a hydrophobic chain of from 8 to 20 carbon atoms.

4. The method of claim 3, wherein said hydrophobic chain comprises from 10 to 18 carbon atoms.

5. The method of claim 4, wherein said hydrocarbon chain comprises from 12 to 16 carbon atoms.

6. The method of claim 5, wherein said surfactant is cetyl trimethyl ammonium bromide, or dodecyl trimethyl ammonium bromide.

7. The method of claim 2, wherein said acid is $H_2SO_4$.

8. The method of claim 1, further comprising reacting said atomic oxygen with $H^+$ ions and $H_2O$ at a pressure of from 450-600 psia.

* * * * *